United States Patent [19]

Wolnowsky et al.

[11] 4,091,237

[45] May 23, 1978

[54] BI-PHASE HARMONIC HISTOGRAM PITCH EXTRACTOR

[75] Inventors: Howard Ervin Wolnowsky, Mountain View; Erling Norris Belland, San Mateo; Harry Thomas Lee, Sunnyvale, all of Calif.

[73] Assignee: Lockheed Missiles & Space Company, Inc., Sunnyvale, Calif.

[21] Appl. No.: 798,922

[22] Filed: May 20, 1977

Related U.S. Application Data

[63] Continuation-in-part of Ser. No. 619,895, Oct. 6, 1975, abandoned.

[51] Int. Cl.[2] ..... G10L 1/00

[52] U.S. Cl. ..... 179/1 SC

[58] Field of Search ..... 179/1 SC, 1 SA

[56] References Cited

U.S. PATENT DOCUMENTS

| | | | |
|---|---|---|---|
| 3,420,955 | 1/1969 | Noll | 179/1 SC |
| 3,875,336 | 4/1975 | Mullen | 179/1 VC |

OTHER PUBLICATIONS

R. Miller, "Performance Characteristics of an Experimental etc.", J. of Ac. Soc. Am., 1970 pp. 1593–1598.

*Primary Examiner*—Kathleen H. Claffy
*Assistant Examiner*—E. S. Kemeny
*Attorney, Agent, or Firm*—H. Donald Volk

[57] ABSTRACT

A digital voice pitch extractor is disclosed that determines the pitch frequency of human speech in real-time or at the same rate as it is uttered. The invention does not need the full bandwidth of the speech signal in order to perform its function. It will accept band-limited signals lacking fundamental pitch energy such as those from telephone channels. The signal can be severely degraded by added noise and the pitch extractor will still reliably determine the pitch.

The invention includes a bank of contiguous bandpass filters. The outputs of each of the filters are converted to pulse trains and are summed to form a bi-phase harmonic histogram. The fundamental period is derived from the histogram and is verified by an error correction circuit.

The circuit stability and accuracy needed to perform this task is achieved through the use of digital, as opposed to analog, electrical circuits in the main portion of the voice pitch extractor and the use of noise minimizing techniques.

8 Claims, 3 Drawing Figures

BI-PHASE HARMONIC HISTOGRAM PITCH EXTRACTOR

CROSS-REFERENCE TO RELATED APPLICATION

This application is a continuation-in-part of co-pending U.S. Pat. application Ser. No. 619,895 filed Oct. 6, 1975, now abandoned.

BACKGROUND OF THE INVENTION

The human voice is a complex signal. A number of parameters are used to describe significant characteristics of the voice signal. Among them are the "pitch" or fundamental frequency of the voice signal, "formant" or oral and nasal cavity resonant frequency and amplitude, and voiced/unvoiced time division of the voice signal. A voiced sound is one in which the vocal cords are active and an unvoiced sound is one in which the sound is generated without involvement of the vocal cords.

The voiced portions of the human speech signal are at a higher power level and of longer duration than the unvoiced portions. The voiced portions always have an associated pitch which is the instantaneous vibration frequency of the vocal cords. In voice signal processing it is of overriding importance to know the pitch during voiced portions of the speech signal.

The fundamental frequency, or pitch, of voiced human speech sounds will occur in the range of 80 to 300 Hertz. In general, the lower portion of this range will be male voices while the higher pitch frequencies occur in female and children's voices. Any single individual will have a limited pitch range but will also display a significant pitch variation in the voiced sections of normal speech.

The human ear senses pitch of a sound by the frequency separation of the pitch harmonics. Sound energy at the pitch frequency can be of low amplitude, or even absent, compared with the energy at the pitch harmonic frequencies.

A statistical process for obtaining voice pitch by means of a histogram concept was proposed by M. R. Schroeder (Journal of Accoust. Soc. of America, Volume 43, pp. 829–834) in Jan. 1968. One approach utilizing the concept is shown in Miller's Pat. No. 3,535,454. The new apparatus disclosed herein is considerably different from that claimed by Miller. The prior art revealed by Miller employs a gate structure which blocks signals below noise in individual channels and an envelope detection and gating apparatus which will block desired signals in the presence of noisy envelopes. The inclusion of noisy channels in the histogram generation provides signal enhancement in the presence of high noise inputs since the noise will be essentially decorrelated while any signal component (even if below noise) will contribute to the harmonic peak.

The disclosed apparatus is designed to operate in a high noise environment and is therefore an improvement over the prior art. In such a noisy environment, the prior art does not provide means for obtaining voiced/unvoiced decisions. Harmonic energy measurement provides such a means in that the total energy of the correlated harmonic sum is measured independently of the uncorrelated noise. By well-known threshold comparing or similar techniques, the presence of voiced signal in a high noise environment can be determined, simultaneously with the pitch measurement process.

Additonally, this energy measurement provides an indication of pitch signal strength which can be used to normalize signal amplitudes in speech encoding devices. The generation of such a harmonic energy measurement output for noise degraded speech processing is an improvement over the prior art. The disclosed apparatus uses a common digital clock to measure all channel periods, develop all period pulse trains and measure the time of peak-sum occurrence. This approach is an improvement over the prior art wherein variations in simultaneous independent measurements and/or pulse generation can accumulate to degrade accuracy. By referencing all measurements to a common clock signal, a minimization of relative measurement error is achieved.

The Miller patent and publication (Journal of Accoust. Soc. of America, Vol. 43, pp. 1593–1601) discloses a low pass filter within the period translation apparatus with the disclosed purpose of blocking beat frequency effects. Such a filter will require a maximum cutoff frequency below the fundamental frequency of interest. Given that filter criteria, and a lowest measurement of 67 to 70 Hertz as in Miller, a significant amount of low frequency noise could still be passed through the period translators, particularly in the 20 to 60 Hertz region. The disclosed improved device provides additional low pass filtering, down to the minimum compatible with normal speech dynamics. This additional and unobvious constraint leads to significant improvement in performance against noise since only those noise and signal components in the information bandwidth of interest will be passed and the noise components are subsequently decorrelated in the summation process. The digital low pass filters perform the required circuitry function as discussed in the description of the preferred embodiment. In contrast to the Miller system which shows error removal after the summation and analysis of all channels is performed, the disclosed system provides for maximum noise suppression prior to the synchronization and summation of each channel thereby improving the quality of signals upon which peak detection will be performed. Miller points out that in his system, "In addition to the gross-type errors . . . there are also small perturbations of the measured pitch. These run from approximately 2% at O dB S/N." It is just these noise induced errors that the disclosed approach addresses by (1) reducing the filter bank bandwidths to achieve improved channel period signal to noise ratios (65 Hertz instead of Miller's 75 Hertz), (2) additional filtering criteria applied to each period translation circuit as discussed above, and (3) optimization of the peak detection circuitry discussed below.

Miller does not address the problem of noise induced errors, but his disclosed error correction logic circuitry would block some of the necessary measurements needed for noise correction. An additional benefit of the present invention is that the error correction logic need only address gross-type errors introduced by peak detection discrimination errors. Significant noise removal prior to peak detection will also reduce the rate of occurrence of gross errors as a function of S/N input, since the probability of errors introduced by noise derived harmonic misalignment is reduced.

A significant improvement in gross error production is achieved by employing a new modification to the histogram concept disclosed in the prior art. The modified process is herein designated as a "bi-phase harmonic summation." The bi-phase process utilizes both positive and negative excursions of harmonically related pulse trains. Improved performance over the prior art is realized by algebraic cancellation of amplitude components when an even harmonic is summed algebraically with a harmonic of twice the period (half the frequency). This is shown in FIG. 2 for the equal weighted case, but the half frequency component need not be equal in amplitude for improvements to occur. All negative residues in the sum are discarded in the peak energy detection process. Thus a signal with strong even harmonic content will contribute a half period peak reduced by the sum of all odd harmonic amplitudes. This half period peak reduction allows improved discrimination against even harmonic (T/2) type measurement error. Such errors are a major percentage of the errors obtained in the prior art which employs simple magnitude-sum histogram techniques. The minimization of the T/2 type error source can improve error performance in another way. The peak discrimination ratio represented by $\Delta$ A in FIG. 2 can be lowered to reduce 2T type errors occurring when noise causes the second occurrence of the fundamental peak to be larger than the first occurrence.

Another approach to viewing the difference between the implementations is to consider noise effects of two types. These are input noise effects and processing noise effects. The concept as proposed by Schroeder has a degree of input noise suppression capability due to decorrelation of noisy channels which have no harmonic information within their passbands. The approach disclosed adds error correction logic to reduce processing noise effects. The present approach adds additional filtering requirements to further suppress input noise (i.e., within a channel containing harmonic energy) and provides a common measurement reference, a modified histogram technique and improved peak detection to reduce system noise.

The peak detection apparatus of the present invention responds to the peak value of the summed pulse generator outputs. Noise components in the outputs of the generators are summed in root-sum square fashion with the result that the narrow summation pulse observed under high S/N conditions becomes spread out under low S/N, still retaining the same total area. The optimum peak detector under this low S/N condition includes a filter whose impulse response has the same shape and duration as the spread summation pulse and which senses the peak (or zero slope) instant of the "matched" filter output. This optimum circuit is realized with a combined Bessel filter — differentiating circuit as shown in FIG. 3 (Bessel filter — zero slope detector). Simpler approaches, such as the peak sense and hold circuit used by Miller, will have too much filter bandwidth, resulting in excessive noise induced in the measured pitch period. This noise can originate from the input or from circuit errors prior to peak detection. The measurement errors are caused by insufficient averaging of the spread summation pulse and phase shifts associated with low pass filters not possessing the constant delay characteristics of Bessel filters.

In summary, the disclosed circuitry has more noise tolerance than the prior art due to the unique combining of the following characteristics of the circuit: (1) reduced bandpass filter bandwidth to improve individual harmonic signal to noise ratios in each pass band channel; (2) additional filtering of period data to minimize input noise induced period measurement errors; (3) harmonic energy measurement (i.e., voiced signal strength) to augment the processing of noisy signals with the apparatus; (4) peak detection of zero slope/Bessel filter for improvement in noise tolerance; (5) the utilization of a common signal measurement/pulse generation reference to minimize processor induced noise effects; (6) the minimization of noise induced errors prior to summation/peak detection; and (7) the inclusion of circuits to utilize the technique of bi-phase histogram to improve performance.

The disclosed approach, utilizing digital processing techniques as well as digital word signal interfaces, employs digital error correction also, but on a noise suppressed processing product that is already in a digital word format. Although a specific error correction technique is not specifically disclosed as this is well-known art, it is assumed obvious that the error statistics prior to error correction will be different for this system compared to the prior art.

A process to determine what pitch dynamics are produced by normal speakers is not claimed (although the disclosed apparatus has this capability) but indicates how such information can be used in this system by those skilled in the art. Since it is a stated objective of the claimed system to process speech signals in a high noise environment, the selection of optimum criteria to limit normal frequency changes will depend on the speaker population of interest, the noise levels (both ambient and peak), and the desired final corrected error statistics. It is believed that a user skilled in the art may wish to select his own alterable criteria, dependent on the above stated considerations. Details of the selection criteria were not deemed valid subject matter for this patent application as sufficient disclosure of means (circuitry) is made for performing the specified function. Actions to be taken by a person skilled in the art with respect to frequency change rate criteria selection are dependent on a broad range of possible applications.

U.S. Pat. No. 3,420,955 to Noll discloses an alternative pitch measuring apparatus which does not use the harmonic summation concept. It has digital control means but relies on analog processing techniques. It is representative of the prior art in that the pitch measurement means (in this case via a spectrum thresholding technique) is not particularly noise immune.

SUMMARY OF THE INVENTION

The preferred embodiment of the invention shows a method of determining in real-time the pitch of acoustic signals such as that of the human voice in a noise degraded environment. A bank of contiguous bandpass filters spans the expected frequency range of the fundamental pitch and the lower harmonic pitch frequencies. These bandpass filters separate a portion of the incoming voice signal energy into individual harmonics of the pitch frequency. The bandpass filter outputs each control a digital pulse generator in which the phase can be instantaneously set to zero electrical degrees. The digital circuits generate bi-phase pulses whose power is controlled to be proportional to the sound power in the associated bandpass filter, and whose rate follows the bandpass filter signal rate. These pulses are summed to form a composite wave form. This signal will have maximum amplitude at a time period corresponding to the fundamental frequency of the sound signal. This maximum pulse amplitude is detected and the pitch signal output derived therefrom at the same rate as the original speech signal is delivered. Additive noise degradation of the original sound signal is effectively discriminated against. Most of the circuitry subsequent to the bandpass filters is digital, as opposed to analog, in order to achieve the requisite stability and accuracy.

BRIEF DESCRIPTION OF THE DRAWINGS

The features of the invention believed to be novel are set forth with particularity in the appended claims. The invention itself, however, both as to its organization and the method of operation may best be understood by reference to the following description taken in conjunction with the accompanying drawings in which:

DESCRIPTION OF THE PREFERRED EMBODIMENT

Figure 1:
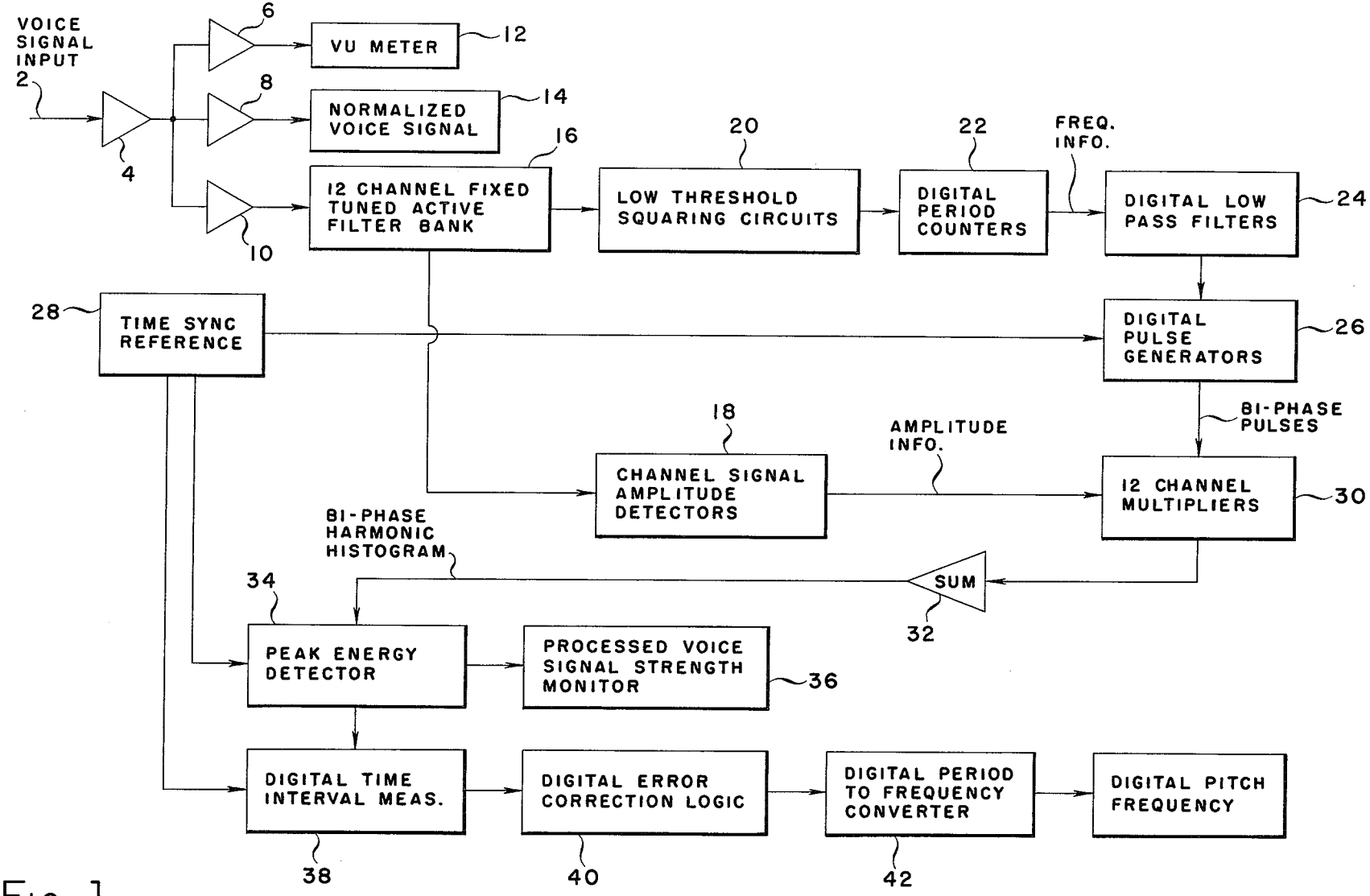
FIG. 1 is a block diagram of the fundamental pitch extractor of the present invention.

Referring to FIG. 1, sound waves entering the system by way of input line 2 are amplified to a suitable level for processing by input amplifier 4. Isolation amplifiers 6, 8 and 10 are connected to the output of the input amplifier 4. A conventional monitor, such as meter 12, can be connected to the output of isolation amplifier 6 and is provided to aid in adjusting the gain of input amplifier 4. An audio monitor 14 can be connected to the output of isolation amplifier 8 to provide an audio indication of the input signal.

An active filter bank 16 is connected to the output of isolation amplifier 10. The active filter bank 16 comprises 12 contiguous bandpass filters that together span from 105 Hertz to 885 Hertz, a range wherein most voiced energy will be found. Each bandpass filter has a 65 Hertz, 3 *db* bandwidth. The function of the active filter bank 16 is to separate the fundamental frequency and its first few harmonics, below about 900 Hertz. The output of each of the bandpass filters in active filter bank 16 is connected to an individual channel amplitude detector 18 and a low amplitude threshold comparator circuit 20.

Each channel amplitude detector 18 consists of a full-wave rectifier followed by a single pole pair 50 Hertz low pass filter. The purpose of the amplitude detector is to utilize the difference in amplitude between the harmonics of the fundamental pitch and the broader spectrum of noise or unvoiced signals in a subsequent signal processing circuit, the multiplier 30.

Each low threshold comparator circuit 20 generates a fixed amplitude square wave of the same frequency as the filter output. The purpose of the threshold comparator circuit is to provide logic level transitions at signal zero crossing such that the time interval between the logic level transitions may be used to measure the time between successive zero crossings of the filter output and hence derives the frequency of the dominant signal appearing in each filter output. In addition, the threshold comparators will provide a signal near channel band center if broad band noise is present in a channel. This provides an in-band reference to the digital filters 24 when voiced signals are not present, allowing improved start-up characteristics.

The output of each threshold comparator circuit 20 is connected to the input of a digital period counter 22. Each digital period counter 22 measures the period of its input square wave and provides a digital word output which is inversely proportional to its associated bandpass filter frequency.

A digital low pass filter 24 is connected to the output of each digital period counter 22. These filters have a frequency cutoff of approximately 10 Hertz. Since voiced sounds rarely exhibit pitch dynamic changes of 5 Hertz or more during normal speech, the low pass filters 24 effectively block any higher rate changes in the signal which are generated by noise or unvoiced sounds.

Figure 2:
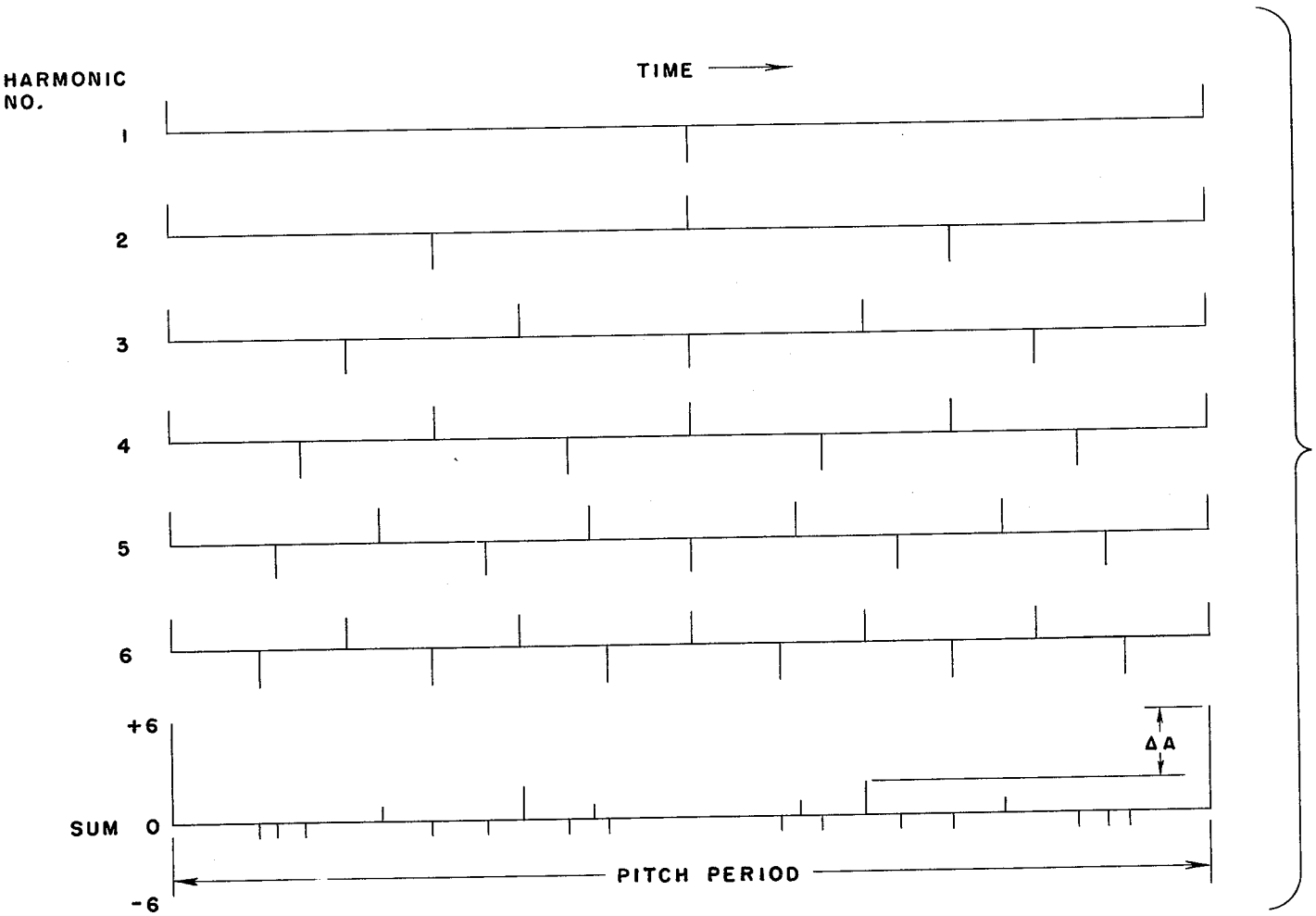
FIG. 2 is a representation of the bi-phase harmonic pulse summing to form the histogram.

The output from each digital low pass filter is connected to a separate digital pulse generator 26. The digital pulse generators 26 generate bi-phase pulse trains having repetition frequencies equal to 16 times the reciprocal of the input periods (i.e., 16 times the input frequency) from the low pass filters 24. The magnitude and duration of the output pulses generated by all the generators 26 are all equal with alternating positive and negative values. A time synchronization reference 28 is also connected to each digital pulse generator 26. The purpose of the time synchronization reference 28 is to synchronize the positive pulse start time of the outputs of all the digital pulse generators 26 so that if the output period of two or more generators are integer multiples of each other, the output pulse from these generators will coincide at the times of the lower frequency pulses. See FIG. 2.

The digital pulse generators are basically presetable count-down registers which load an input count whenever a zero output (counter underflow) or a synchronizing pulse occur. When an input count of "N" is loaded from the digital filter by a synchronizing pulse, an underflow (zero count) occurs exactly "N" clock pulses later. This underflow causes the counter to be reset to "N" and the process repeats, resulting in an underflow pulse every "N" clock cycles from the synchronizing pulse. Each pulse generators clock is exactly 32 times the corresponding digital period counter clock so that the pulse generator underflow occurs 32 times faster than its respective channel input. The digital filter restricts the rate of change in pulse output frequency as described above.

The pulse underflow signals are connected to the channel multipliers 30 via switching circuits which route pulses in alternation to the positive or negative inputs of the two quadrant multipliers. These switching circuits, which are reset by the synchronizing pulse, provide the bi-phase signals at 16 times the channel input frequency.

The outputs from the 12 digital pulse generators 26 are each connected to one channel of a 12-channel two quadrant multiplier 30. Similarly, the corresponding 12 outputs from the channel amplitude detectors 18 are also connected to the 12-channel multiplier. The function of the multiplier 30 is to amplitude weigh the output from each of the digital pulse generators 26 with the corresponding output from the amplitude detector to produce a bi-phase output pulse train having a frequency proportional to the output from the digital pulse generator 26 and a magnitude proportional to the output from the amplitude detector 18.

A summation amplifier 32 is connected to the 12-channel outputs from the multiplier 30. The function of the summation amplifier 32 is to algebraically sum the pulses from the multiplier 30 to form a time synchronized bi-phase composite pulse train. The composite pulse train will contain pulses of higher positive magnitude where harmonic signals are present since the time coincident pulses will sum together.

Figure 3:
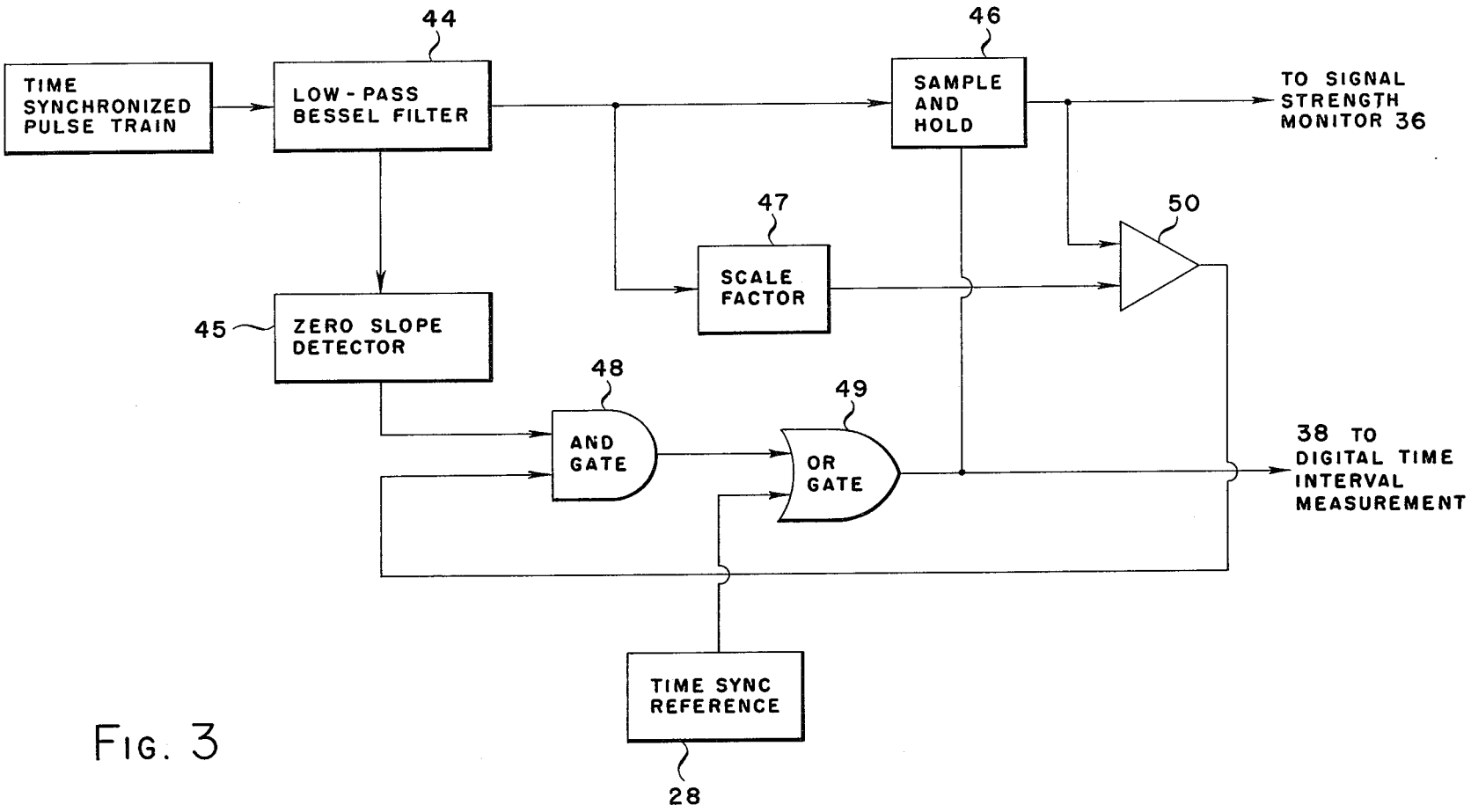
FIG. 3 is a schematic block diagram of the peak energy detector 34.

A peak energy detector 34 is connected to the output from the summation amplifier 32. The peak energy detector, which is shown in FIG. 3 and explained in detail below, comprises a system of filters and sample-and-hold circuits. The peak energy detector 34 produces pulse outputs coincident in time with the peak energy of the composite wave train. One output from the peak energy detector 34 provides an output voltage proportional to the peak energy of the composite wave train. This output is connected to a signal strength monitor 36. The function of the signal strength monitor 36 is to measure the magnitude of harmonic energy contained in the input signal. The peak energy measurements are filtered by the monitor circuit to produce a signal proportional to harmonic energy which can aid users in making voiced/unvoiced input signal determinations. The second output from the peak energy detector 34 is connected to a digital time interval measurement system 38.

An output from the time synchronization reference 28 is also connected to the digital time interval measurement system 38. The digital time interval measurement system 38 measures the time difference between the first occurrence of the largest peak pulse and the time synchronization reference.

The digital time interval measurement system 38 receives a pulse whenever the peak detector senses a higher peak than any prior peak within one measurement cycle (synchronizing pulse to next synchronizing pulse). Several successively higher peaks will be sensed during a normal cycle. A time counter is started at zero count by the synchronizing pulse. When a peak is sensed, the peak detector outputs a trigger pulse which causes the counter value to be transferred into a temporary holding register. Successive peak times replace earlier time words in the holding register. At the end of the measurement cycle (start of next cycle) the holding register value is transferred to an output register. The output register will therefore contain the time of the first occurrence of the largest peak within each measurement cycle and can change values with each synchronizing pulse.

Digital error correction logic means 40 is connected to the output from the digital time interval measurement system 38. This correction logic means 40 compares successive output values from the measurement system 38 and suppresses noise induced large magnitude changes in the measured time interval greater than those selected by the user of the system via internal logic connections (not shown). The selected values would typically be chosen to limit changes to those occurring naturally within voiced speech.

Digital period to frequency converter 42 is connected to the output from the digital error correction logic means 40 and provides a digital word that is proportional to the measured pitch frequency through the use of well-known digital divider circuitry.

FIG. 3 shows the details of the peak energy detector 34. The composite bi-phase pulse train from summation amplifier 32 is fed to a low pass Bessel filter 44 of conventional active filter design. The filtered output is applied to the input of a sample-and-hold circuit 46 and is multiplied by a constant of about 0.9 in circuit 47. If the scaled output from circuit 47 is larger than the amplitude value stored in 46, the comparator 50 output changes state, commanding via gates 48 and 49 sample-and-hold 46 to store the new amplitude value. The time of occurrence of the pulse peak of the new pulse is needed. The zero slope detector 45 gates the comparator 50 output at the peak pulse time through to the sample-and-hold 46 control input and to the time interval measurement circuit 38. The sample-and-hold 46 is reset at the end of the observation period by the time synchronization reference 28 signal via "OR" gate 49.

Other modifications and advantageous applications of this invention will become apparent to those having ordinary skill in the art. Therefore, it is intended that the matter contained in the foregoing description and the accompanying drawings be interpreted as illustrative and not limitative, the scope of the invention being defined by the appended claims.

What is claimed is:

1. A digital voice pitch extractor comprising:

first means for amplifying the electrical signal representative of speech;

second means connected to said first means for filtering the said electrical signal and for separating said electrical signal into individual harmonics of the pitch frequency of the said electrical signal;

third means connected to said second means and responsive to said individual harmonics for forming a bi-phase harmonic histogram and deriving the fundamental frequency of said electrical signal.

2. The system of claim 1 wherein said second means is further defined as including:

a plurality of bandpass filters for dividing said electrical signal into predetermined frequency bands;

means connected to the respective outputs of each of said pluralities of bandpass filters for generating a fixed amplitude square wave of the same frequency as the respective filter output in response to said respective bandpass filter output;

means connected to each of said square wave generating means for providing a digital word output representative of the associated bandpass filter frequency;

digital low pass filter means connected to each of said digital word means for blocking frequency changes above the frequency changes normally occurring in voiced sounds to thereby substantially suppress noise prior to the synchronization and summation of the frequency band channels.

3. The system of claim 2 including fourth means connected to said third means to suppress noise induced large magnitude changes in the measured time interval.

4. The system of claim 3 including fifth means connected to said fourth means for converting the signal from said fourth means to an output representative of the pitch frequency of said electrical signal representative of speech.

5. The system of claim 4 wherein said second means is further defined as including:

digital pulse generator means connected to each of said digital low pass filter means for generating bi-phase pulse trains;

channel signal amplitude detector means connected to each of said bandpass filter means;

a multichannel multiplier, each channel of said multichannel multiplier connected to an output of said digital pulse generator means and an output of said channel signal amplitude detector means, said multiplier providing a plurality of bi-phase output pulse trains having a frequency proportional to the output from the respective digital pulse generator and a magnitude proportional to the output from the respective amplitude detector; and wherein said third means is further defined as including, a summation amplifier connected to receive the plurality bi-phase output pulse trains from said multiplier to algebraically sum the said pulses to form a bi-phase composite pulse train;

a peak energy detector including a contant delay filter means, said peak energy detector connected to said summing amplifier for detecting the time of occurrence of peak energy of the output from said summing amplifier and providing an output voltage proportional to the detected peak energy;

digital time interval measurement means connected to said peak energy detecting means; and means for providing a time synchronization reference connected to said digital pulse generator means, said peak energy detector means and said digital time interval measurement means whereby said digital time interval measurement means measures the time difference between the largest peak pulse provided by said peak energy detecting means and the signal provided by said time synchronization reference means.

6. The system of claim 5 wherein said peak energy detector is further defined as including:

a sample-and-hold circuit, a multiplication circuit, and a comparator circuit, the output of said constant delay filter connected to said comparator circuit so that the output of said comparator changes state whenever the output from the multiplication circuit exceeds the output from said sample-and-hold circuit;

said peak energy detector also including a first and second gate circuit, and a zero slope detector;

said zero slope detector connected to said constant delay filter;

the output of said comparator circuit and said zero slope detector means are connected to said first gate means to cause said first gate means to provide an output to said second gate means whenever the output from the multiplication circuit exceeds the output from said sample-and-hold circuit and a signal is received from said zero slope detector;

the output of said second gate means connected to said sample-and-hold circuit to reset said sample-and-hold circuit.

7. The system of claim 2 wherein said second means is further defined as including:

digital pulse generator means connected to each of said digital low pass filter means for generating bi-phase pulse trains;

channel signal amplitude detector means connected to each of said bandpass filter means;

a multichannel multiplier, each channel of said multichannel multiplier connected to an output of said digital pulse generator means and an output of said channel signal amplitude detector means, said multiplier providing a plurality of bi-phase output pulse trains having a frequency proportional to the output from the respective digital pulse generator and a magnitude proportional to the output from the respective amplitude detector; and wherein said third means is further defined as including, a summation amplifier connected to receive the plurality bi-phase output pulse trains from said multiplier to algebraically sum the said pulses to form a bi-phase composite pulse train;

a peak energy detector including a constant delay filter means, said peak energy detector connected to said summing amplifier for detecting the time of occurrence of peak energy of the output from said summing amplifier and providing an output voltage proportional to the detected peak energy;

digital time interval measurement means connected to said peak energy detecting means; and means for providing a time synchronization reference connected to said digital pulse generator means, said peak energy detector means and said digital time interval measurement means whereby said digital time interval measurement means measures the time difference between the largest peak pulse provided by said peak energy detecting means and the signal provided by said time synchronization reference means.

8. The system of claim 7 wherein said peak energy detector is further defined as including:

a sample-and-hold circuit, a multiplication circuit, and a comparator circuit, the output of said constant delay filter connected to said comparator circuit so that the output of said comparator changes state whenever the output from the multiplication circuit exceeds the output from said sample-and-hold circuit;

said peak energy detector also including a first and second gate circuit, and a zero slope detector;

said zero slope detector connected to said constant delay filter;

the output of said comparator circuit and said zero slope detector means are connected to said first gate means to cause said first gate means to provide an output to said second gate means whenever the output from the multiplication circuit exceeds the output from said sample-and-hold circuit and a signal is received from said zero slope detector;

the output of said second gate means connected to said sample-and-hold circuit to reset said sample-and-hold circuit.

* * * * *